United States Patent [19]

Blandenet et al.

[11] Patent Number: 4,618,508

[45] Date of Patent: Oct. 21, 1986

[54] PROCESS FOR PRODUCING COMPOSITE LAYERS

[75] Inventors: Gerard Blandenet, Meylan; Jean-Jacques Chazee, Grenoble; Michel Court, Echirolles, all of France

[73] Assignee: Commissariat a l'Energie Atomique, Paris, France

[21] Appl. No.: 682,352

[22] PCT Filed: Mar. 21, 1983

[86] PCT No.: PCT/FR84/00073

§ 371 Date: Nov. 21, 1984

§ 102(e) Date: Nov. 21, 1984

[87] PCT Pub. No.: WO84/03720

PCT Pub. Date: Sep. 27, 1984

[30] Foreign Application Priority Data

Mar. 21, 1983 [FR] France ..... 83 04565

[51] Int. Cl.[4] ..... B05D 3/12

[52] U.S. Cl. ..... 427/57; 427/123; 427/126.3; 427/422; 427/427

[58] Field of Search ..... 427/57, 123, 126.3, 427/422, 427

[56] References Cited

FOREIGN PATENT DOCUMENTS 2068935 8/1981 United Kingdom .

OTHER PUBLICATIONS

Patents Abstracts of Japan, vol. 1, No. 126, 10/20/77, p. 5480E77, & JP, A, 5259888 (Denki).

Thin Solid Films, vol. 77, No. 1-3, Elsevier Sequoia (NL) G. Blandenet et al., "Thin Layers Deposited by the Pyrosol Process", pp. 81-90.

*Primary Examiner*—Bernard D. Pianalto

*Attorney, Agent, or Firm*—Oblon, Fisher, Spivak, McClelland & Maier

[57] ABSTRACT

The process, consisting of successively depositing upon one another the layers produced from chemical compounds, the first layer (2) being deposited on a substrate (3), is characterized in that each layer is deposited immediately after the preceding layer, and in that the depositions of the layers are performed by reactive chemical spraying and at temperatures determined by the compounds to be deposited, a chemically inert atmosphere being maintained between each deposition.

3 Claims, 2 Drawing Figures

PROCESS FOR PRODUCING COMPOSITE LAYERS

The present invention relates to a process and apparatus for producing composite layers. It more particularly applies to producing electrodes for liquid medium display cells and transparent heating members, e.g. making it possible to deice panes of glass.

Process are known which make it possible to produce composite layers, e.g. constituted by a first tin-doped indium oxide layer, deposited on an e.g. glass substrate, and by a second fluorine-doped or antimony-doped tin oxide layer deposited on the first layer.

A first process consists of depositing the first layer by radio-frequency cathodic sputtering, then performing a vacuum annealing of said first layer, followed by the deposition of the second layer, also by radio-frequency cathodic sputtering.

This first process suffers from the disadvantage of requiring a heat treatment (vacuum annealing) following the deposition of the first layer, which reduces the resistivity of the said layer to values compatible with the envisaged applications for the composite layers in question. The object of this vacuum thermal annealing is to increase the stoichiometry difference, the main element of the conductivity of these oxides.

A second process consists of depositing the first layer by the reactive chemical spraying of aerosols obtained ultrasonically or pneumatically on to the substrate in a known apparatus provided for this purpose, and at a temperature exceeding ambient temperature, which is roughly 20° C. From the said apparatus is then removed the assembly constituted by the substrate and the first layer and said assembly is then brought into the open air, where it is cooled to ambient temperature. The assembly is then placed in the apparatus again and the second layer deposited by reactive chemical spraying of aerosols obtained ultrasonically or pneumatically, after previously reheating the substrate and the first layer.

Due to the known apparatus used in the performance thereof, the second process suffers from the disadvantage of requiring separate depositions of two layers, with a return to air (at ambient temperature) after depositing the first layer. Thus, it does not make it possible to obtain tin-doped indium oxide layers with a low electrical resistivity, i.e. an electrical resistivity at the most equal to $2.5 \cdot 10^{-4} \Omega \cdot cm$. As a matter of fact the electrical properties of the first layer are affected by the reduction in the stroichiometry difference of the indium oxide, resulting from the air oxidization of the first layer during its cooling or its reheating prior to the deposition of the second layer.

The object of the present invention is to obviate the aforementioned disadvantages by proposing a process and an apparatus making it possible to produce conductive composite layers with a low electrical resistivity and without heat treatment. More generally, the present invention aims at obviating the disadvantages of the known process for producing composite layers, in which certain physical properties, such as the electrical resistivity are modified during the production of said layers, e.g. by oxidation.

More specifically, the present invention relates to a process for producing composite layers, constituted by a first layer and at least one further layer, produced from chemical compounds, the layers being superimposed, said process consisting of successively depositing the layers on top of one another, the first layer being deposited on a substrate, characterized in that each layer is deposited immediately following the preceding layer and in that the depositions of the layers are performed by reactive chemical spraying and at temperatures determined by the compounds to be deposited, a chemically inert atmosphere being maintained between each deposition.

Any modification to the physical properties of the thus deposited layers is prevented by maintaining a chemically inert medium between each layer deposition. The term "chemically inert medium or atmosphere" is understood to mean e.g. a nitrogen or a rare gas atmosphere. The term "temperatures determined" is understood to mean the temperatures at which the reactive chemical spraying operations have to be performed and which are obviously a function of the compounds to be deposited and of the nature of the substrate and the previously deposited layers.

Obviously, the deposition of the final layer is followed by cooling in ambient air of the composite layers obtained, the final layer acting as a protective barrier for all the other layers deposited before it.

For example, the substrate is formed from an electrically insulating material, such as glass.

According to a special feature of the process according to the invention, at least the first layer is formed from an electrically conductive material.

According to another special feature, there are two layers, the other layer consequently forming a second layer, the first layer being formed from tin-doped indium oxide and the second layer is formed from tin oxide doped with one of the two elements fluorine or antimony. The composite layers obtained then have a very low resistivity and also a high optical transmission.

According to another special feature, the reactive chemical spraying is ultrasonic spraying.

According to another special feature, said reactive chemical spraying is pneumatic spraying.

The present invention also relates to an apparatus for producing composite layres constituted by a first layer and at least one other layer, the layers being produced from chemical compounds and are successively deposited on top of one another, the first layer being deposited on a substrate, characterized in that it comprises a first chamber for the deposition of the first layer and followed by at least one other chamber for the deposition of said other layer, each chamber being linked with the following chamber by means of a heating transfer means filled with a chemically inert atmosphere; means for displacing the substrate from one chamber to the next, cooperating with said heating means, each chamber being provided with means for the deposition by reactive chemical spraying, of the layer corresponding thereto, the chambers and the heating transfer means being kept at temperatures determined by the compounds to be deposited.

The production apparatus according to the invention makes it possible to deposit the layers immediately following one another at temperatures adapted to each compound to be deposited and, following its deposition and up to the time of the deposition of the following layer, makes it possible to keep each layer in a chemically inert medium, so as to prevent any modification of the properties of preceding layers during their passage in the heating transfer means.

The invention will be better understood from reading the following description of an illustrative and non-limitative embodiment and with reference to the attached drawings, wherein show:

DETAILED DESCRIPTION OF THE DRAWINGS

Figure 1:
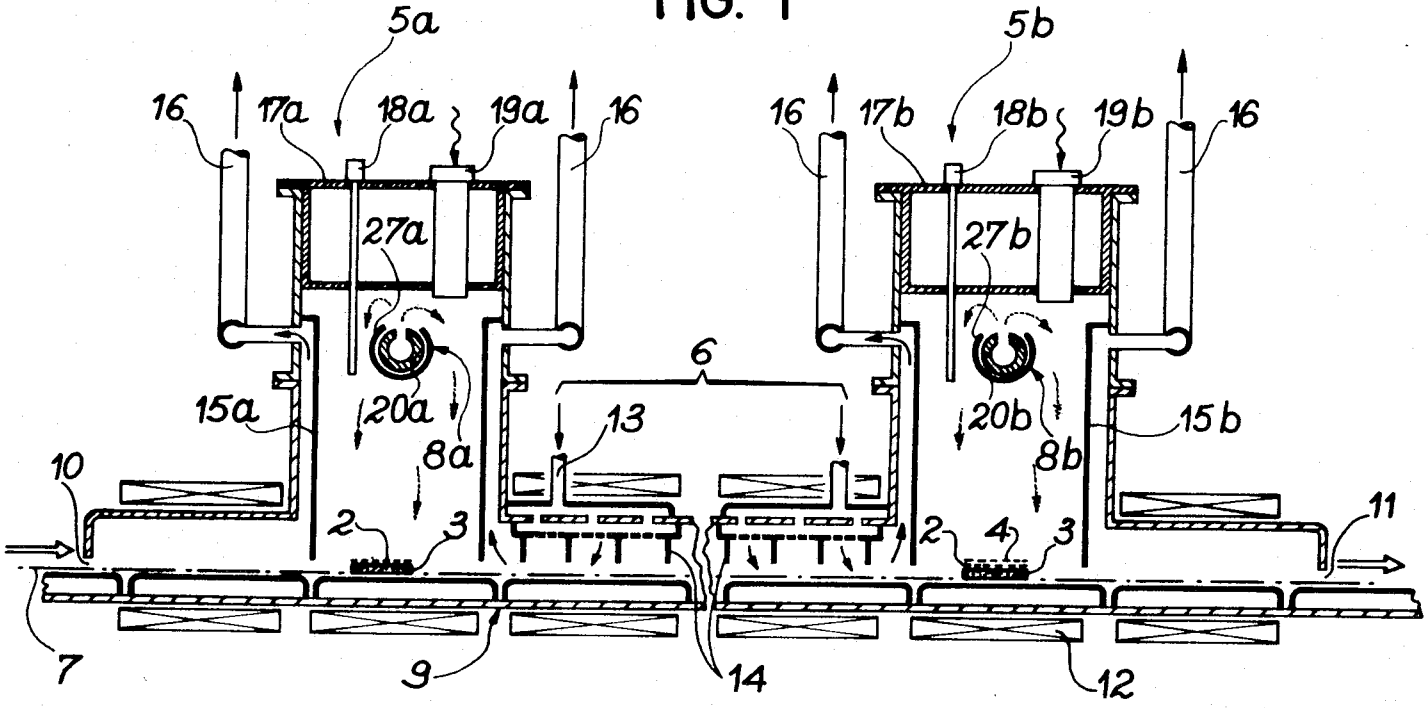
FIG. 1 a diagrammatic view of a special embodiment of the apparatus according to the invention.

FIG. 1 diagrammatically shows a special embodiment of the apparatus according to the invention making it possible to produce composite layers, e.g. constituted by a first electrically conductive layer 2 formed from tin-doped indium oxide and deposited on an electrically insulating substrate 3, such as a glass plate, and by a second electrically conductive layer 4, formed from fluorine-doped or antimony-doped tin oxide and deposited on the first layer 2.

The apparatus shown in FIG. 1 essentially comprises a first chamber 5*a* for the deposition of the first layer 2, a second chamber 5*b* for the deposition of the second layer 4, a heating transfer means 6 linking the two chambers 5*a*, 5*b* and means 7 for displacing substrate 3 from the first enclosure 5*a* to the second enclosure 5*b*, via transfer means 6. Each chamber 5*a* or 5*b* is provided with means 8*a* or 8*b* for depositing the layer 2 or 4 corresponding thereto by spraying.

The apparatus shown in FIG. 1 can be realized with the aid of a so-called passage furnace 9, which is e.g. horizontally arranged and on which are vertically mounted in succession the two chambers 5*a*, 5*b*, in such a way that they are linked with furnace 9. The transfer means 6 is then constituted by that part of furnace 9 between the two chambers 5*a* and 5*b*. Furnace 9 obviously has an inlet 10 and an outlet 11, respectively used for introducing substrate 3 into furnace 9 and for recovering substrate 3, provided with layers 2 and 4 once these have been formed. The furnace 9 also has a conveyor belt constituting said displacement means.

Obviously, furnace 9 could have more than two linked chambers arranged in successive manner, if it was desired to deposit more than two layers on the substrate.

Furnace 9 and chambers 5*a* and 5*b* are provided with known heating means 12, e.g. electrical resistors, so that the chambers and the furnace, particularly part 6 thereof between the chambers to be kept at given temperatures.

Moreover, transfer means 6 is filled with an inert atmosphere, for example constituted by nitrogen. For this purpose, transfer means 6 is provided with pipes 13 permitting the introduction of nitrogen into the transfer means. Baffles 14 are arranged within the transfer means 6, in such a way that the layers are constantly immersed in a nitrogen atmosphere between the two consecutive chambers.

For example, each chamber 5*a* or 5*b* is parallelepipedic and is laterally provided with a double wall 15*a*, or 15*b*, forming a duct for the recovery of reaction gases and nitrogen, which are then removed by pipes 16 issuing on either side of said chamber and which are connected to not shown pumping means. These pipes 16 also make it possible to remove other gases liable to be used in the invention, as will be shown hereinafter. Each chamber 5*a* or 5*b* is connected by its lower part to furnace 9 and is closed in its upper part by a plug 17*a* or 17*b*, which is traversed by a thermocouple 18*a* or 18*b* making it possible to control the temperature prevailing in the corresponding chamber 5*a* or 5*b* and which is also provided with an inspection window 19*a* or 19*b* making it possible to observe what is taking place in chamber 5*a* or 5*b*.

Means 8*a* and 8*b* make it possible to respectively deposit layers 2 and 4 and, for example, are constituted by ultrasonic spraying means of the same type. It is pointed out that the ultrasonic spraying process is known in the art under the name "PYROSOL" and forms the subject matter of French Pat. No. 2 110 622, filed on Oct. 25th 1970 in the name of the Commissariat al'Energie Atomique. The spraying means 8*a* or 8*b* have a nozzle 20*a* or 20*b* formed by a tube closed at its two ends and arranged horizontally within the corresponding chamber 5*a* or 5*b* towards the top thereof and perpendicular to the displacement direction of conveyor belt 7. This tube is perforated by a plurality of holes 21 (FIG. 2) aligned along the tube and at the top thereof. A not shown ultrasonic generator produces an aerosol transported by a vector gas into nozzle 20*a* or 20*b*, provided with a row of holes 21 along the generatrix of nozzle 20*a* or 20*b*. This aerosol is introduced into nozzle 20*a* or 20*b* by a pipe 24 and leaves via holes 21.

Figure 2:
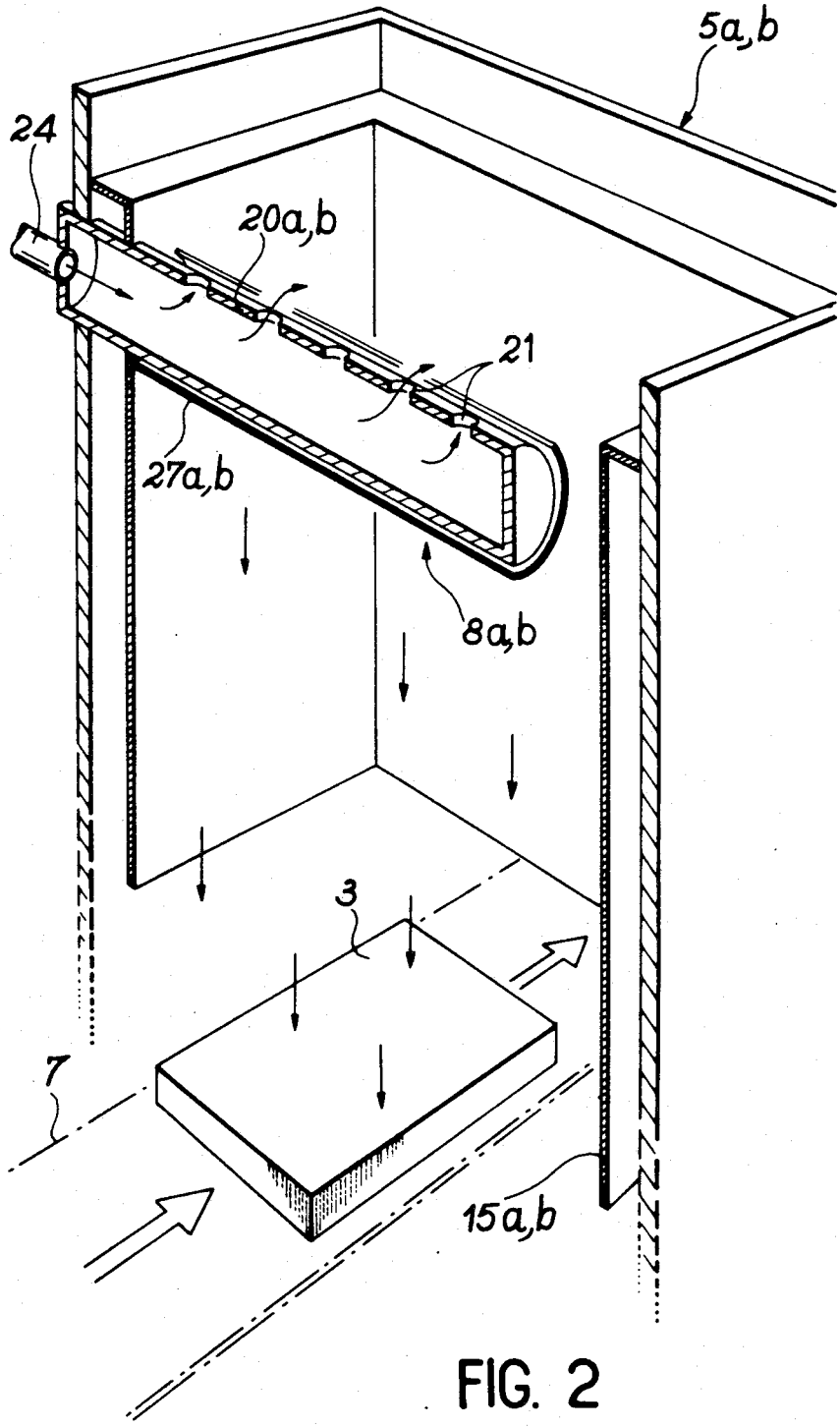
FIG. 2 a diagrammatic view of a special embodiment of the ultrasonic spraying means used in the apparatus of FIG. 1.

FIGS. 1 and 2 also show that the spraying means 8*a* or 8*b* are partly surrounded by a heat shield 27*a* or 27*b*.

In an illustrative and non-limitative embodiment indium acetyl acetonate is dissolved in acetyl acetone in such a way as to give a 0.1N solution. This solution is converted into aerosol by means of an ultrasonic generator (of frequency 800 kHz). This aerosol is directed by an air current (with a flow rate of approximately 10 liters per minute) into nozzle 20*a* of chamber 5*a*, the deposition temperature being approximately 500° C. The indium acetyl acetonate solution used is doped with tin, in such a way that the Sn/In ratio is equal to 2.5 atom %. Moreover, a 0.1N tin tetrachloride solution in methanol is converted into aerosol as hereinbefore by means of an ultrasonic generator (of frequency 800 kHz). This aerosol is transported by an air current (having a flow rate of approximately 10 liters per minute) into the nozzle 20*b* of chamber 5*b*). The operating temperature is in this case approximately 450° C. The tin tetrachloride solution used is doped by fluorine, in such a way that the F/Sn ratio is equal to 5 atom %. The speed of the conveyor belt 7 is, in this case, approximately 1 cm/minute.

The composite layers are produced in the following manner, whilst once again referring to FIG. 1. Substrate 3 is introduced into furnace 9 through inlet 10 thereof, supplied by conveyor belt 7 to the first chamber 5*a*, in which it is to be coated with the first layer 2 and is then conveyed by conveyor belt 7 to the second chamber 5*b* through part 6 of furnace 9, which is between the said two chambers, the second layer 2 being in this case kept at a temperature close to that at which it has been produced (i.e. approximately 500° C.) until the time when the second layer 4 is deposited at approximately 450° C. Substrate 3 provided with the first layer 2 is then covered with the second layer 4 during the passage in the second chamber 5*b* and is then discharged by the conveyor belt 7 to outlet 11 where it is recovered. The cooling of the composite layers obtained can take place in air down to ambient temperature. The second layer acts as a protective layer for the first layer and prevents the oxidation of the latter, which could occur during said cooling.

The respective thicknesses of the layers are determined by the quantity of the products respectively sprayed in order to obtain the layers in each of the two chambers and also by the movement speed of the conveyor belt 7.

It is obvious that the ultrasonic spraying means 8*a* and 8*b* could be replaced by per se known pneumatic spraying means. For example, under the conditions described hereinbefore for the spraying of indium acetyl acetonate and tin tetrachloride, composite layers having the following characteristics were obtained.

A 0.2 μm thick, tin-doped indium oxide layer deposited on a glass substrate has a square resistance of approximately 25Ω (resistance of a square layer portion of random side length for a current flowing between the two opposite sides of the square) and a resistivity of $5 \cdot 10^{-4}$Ω·cm. By depositing in accordance with the invention a fluorine-doped tin oxide layer with thickness 0.2 μm on the preceding layer, composite layers are obtained with an overall square resistace of approximately 7.5Ω, i.e. an overall resistivity of approximately 3.0Ω.cm. Whilst taking the currently obtained value of $6 \cdot 10^{-4}$Ω·cm for the fluorine-doped tin oxide layer, the value $2 \cdot 10^{-4}$Ω·cm is obtained for the tin-doped indium oxide layer. As a matter of fact in the first case, the tin-doped indium oxide layer oxidizes when it is cooled in air following its deposition and its resistivity increases as a result of a reduction in the stoichiometry difference. However, in the second case, the fluorine-doped tin oxide layer prevents this oxidation in air and the resistivity of the protected layer remains low.

The present invention consequently provides advantages compared with the prior art methods for producing composite layers, because it makes it possible to protect any deterioration of covered materials, e.g. the tin oxide layer deposited on the indium oxide layer protects the latter from any oxidation. The invention also makes it possible to retain certain physical properties due to this protection, e.g. due to the tin oxide layer, the resistivity of the indium oxide layer is kept constant and low. Finally, the superimposing of layers makes it possible to produce an interface, which may be imposed by the technology, e.g. in the field of certain liquid medium digital display cells it is necessary to deposit the tin oxide layer on the indium oxide layer.

There are numerous applications of the products obtained, e.g. display cells, transparent heating members, insulation of window panes (infrared radiation reflection), etc.

We claim:

1. Process for producing conductive composite layers constituted by a first layer (2) and a second layer (4), produced from chemical compounds, the layers being superimposed, this process consisting of depositing the first layer (2) on a substrate (3) and then the second layer (4) on the first layer (2), the first layer (2) being formed from tin-doped indium oxide, the second layer (4) being formed from tin oxide doped with one of the two elements fluorine or antimony, wherein the second layer is deposited immediately after the first and the depositions of the layers are carried out by reactive chemical spraying and at temperatures determined by the compounds to be deposited, a chemically inert atmosphere being maintained between each deposition, so that said first layer has an electrical resistivity at the most equal to $2.5 \times 10^{-4}$ Ω·cm, without heat treatment.

2. Process according to claim 1, characterized in that the reactive chemical spraying is an ultrasonic spraying.

3. Process according to claim 1, characterized in that the reactive chemical spraying is a pneumatic spraying.

* * * * *